United States Patent [19]

Lazarchik

[11] Patent Number: 4,785,534

[45] Date of Patent: Nov. 22, 1988

[54] RAZOR

[75] Inventor: Daniel B. Lazarchik, Boston, Mass.

[73] Assignee: The Gillette Company, Boston, Mass.

[21] Appl. No.: 129,473

[22] Filed: Dec. 7, 1987

[51] Int. Cl.[4] ..... B26B 21/00

[52] U.S. Cl. ..... 30/50; 30/89; 30/87

[58] Field of Search ..... 30/47, 50, 57, 89

[56] References Cited

U.S. PATENT DOCUMENTS

| | | | |
|---|---|---|---|
| 3,935,639 | 2/1976 | Terry et al. | 30/47 |
| 4,026,016 | 5/1977 | Nissen | 30/47 |
| 4,083,104 | 4/1978 | Nissen et al. | 30/47 |
| 4,094,063 | 6/1978 | Trotta | 30/47 |

*Primary Examiner*—E. R. Kazenske

*Assistant Examiner*—Willmon Fridie, Jr.

*Attorney, Agent, or Firm*—Scott R. Foster

[57] ABSTRACT

A razor including a handle and a blade unit mounted on the handle for pivotal movement thereon, the blade unit comprising a housing having a blade therein, a pair of projections extending from an underside of the housing toward the handle, and a leaf spring extending from the handle toward the blade unit, the leaf spring being fixed at a first end to the handle, a second end of the leaf spring being disposed between the projections and in contact therewith, the spring being twisted about its lengthwise axis and retained in a twisted condition by the projections, the leaf spring thereby exercising a force on each of the projections to cause the blade unit to be biased toward a neutral position on the handle.

2 Claims, 3 Drawing Sheets

RAZOR

BACKGROUND OF THE INVENTION

1. Field of the Invention

The invention relates to wet shaving razors, and more particularly to a razor of the type in which the head portion is pivotally moveable during a shaving operation.

2. Description of the prior Art

Razors of the type disclosed in U.S. pat. No. 4,026,016, issued May 31, 1977 to Warren I Nissen, are now well known in the art. They are characterized by the fact that the head portion of the razor has the facility for pivoting on the razor handle during a shaving operation, permitting the razor head to conform dynamically to a surface being shaved. The razor head of the '016 patent is urged to a neutral position on the handle by a spring-biased reciprocal follower interacting with cam surfaces on the underside of the head portion. Thus, as the head portion pivots upon the handle, it is always urged to return to its neutral position.

There is also disclosed in the '016 patent, and also in U.S. pat. No. 4,083,104, issued Apr. 11, 1978, to Warren I. Nissen, et al, an alternative embodiment in which the handle is molded of plastic and has extending therefrom toward the head portion a pair of arms molded integrally with the handle. The two arms engage cam surfaces on the underside of the head portion to urge the head portion to a neutral position on the handle.

In U.S. Pat. No. 4,094,063, issued June 13, 1978, to Robert A. Trotta, there is disclosed a razor handle having a plastic leaf spring molded integrally with the handle and adapted to interact with cam surfaces on the underside of a razor head portion pivotally mounted on the handle. In this instance, the spring is in the form of an inverted "U", with the middle of the "U" engaging the cam surfaces.

In U.S. Pat. No. 3,935,639, issued Feb. 3, 1976, to John C. Terry, et al, there is disclosed a razor having a leaf spring extending from a razor handle toward a pivotally mounted razor head portion. The leaf spring is anchored at one end in the handle, with its other end extending into a groove on the underside of the head. Pivoting of the head portion causes the leaf spring to flex and exercise a force on the head portion, biasing the head portion back to a neutral position.

A shortcoming in the above, and similar, systems has been the "feel" of the head portion when in the neutral position. In the neutral position, the '639, '063, and '016 (alternative embodiment) springs exercise little or no force on the head portion, leaving the head portion with an unsupported "feel". The '016 first embodiment is somewhat better in this regard, but requires extensive mechanical structure including the reciprocal follower and the coil spring.

SUMMARY OF THE INVENTION

An object of the present invention is to provide a razor having a simple one-piece molded construction, as in the '063 and '016 (alternative embodiment) device, but in which the integrally molded bias means is effective to exert positive force on the head portion, even when the head portion is resting in its neutral position.

With the above and other objects in view, as will hereinafter appear, a feature of the present invention is the provision of a razor including a handle and a blade unit mounted on the handle for pivotal movement thereon, the blade unit comprising a housing having a blade therein, a pair of projections extending from an underside of the housing toward the handle, and a leaf spring extending from the handle toward the blade unit, the leaf spring being fixed at a first end to the handle, a second end of the leaf spring being disposed between the projections and in contact therewith, the spring being twisted about its lengthwise axis and retained in a twisted condition by the projections, the leaf spring thereby exercising a force on each of the projections to cause the blade unit to be biased toward a neutral position on the handle.

The above and other features of the invention, including various novel details of construction and combinations of parts, will now be more particularly described with reference to the accompanying drawings and pointed out in the the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
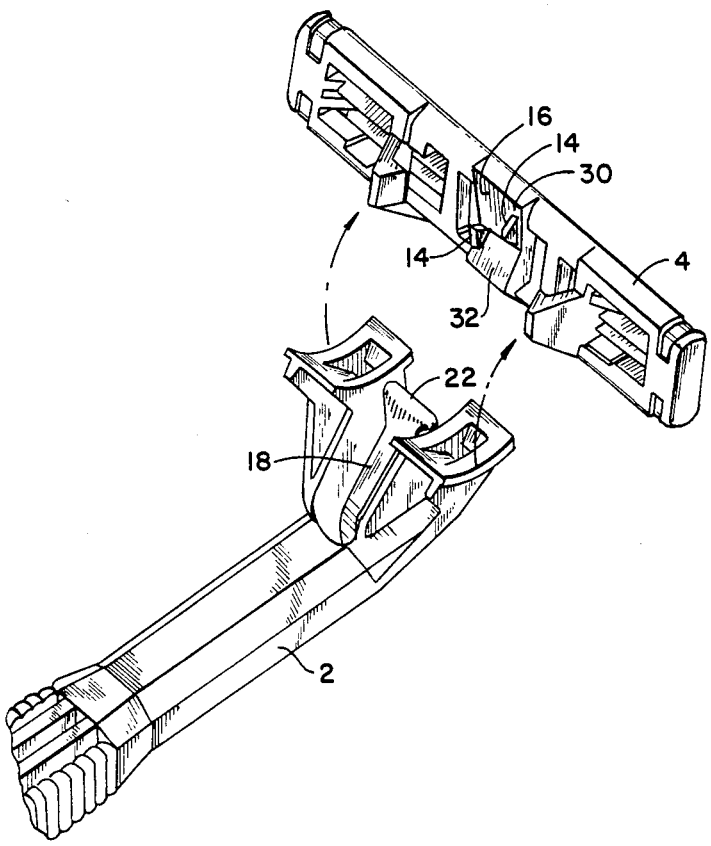
FIG. 1 is a front perspective view of one form of razor illustrative of an embodiment of the invention, showing the blade unit and a portion of the handle.
Figure 2:
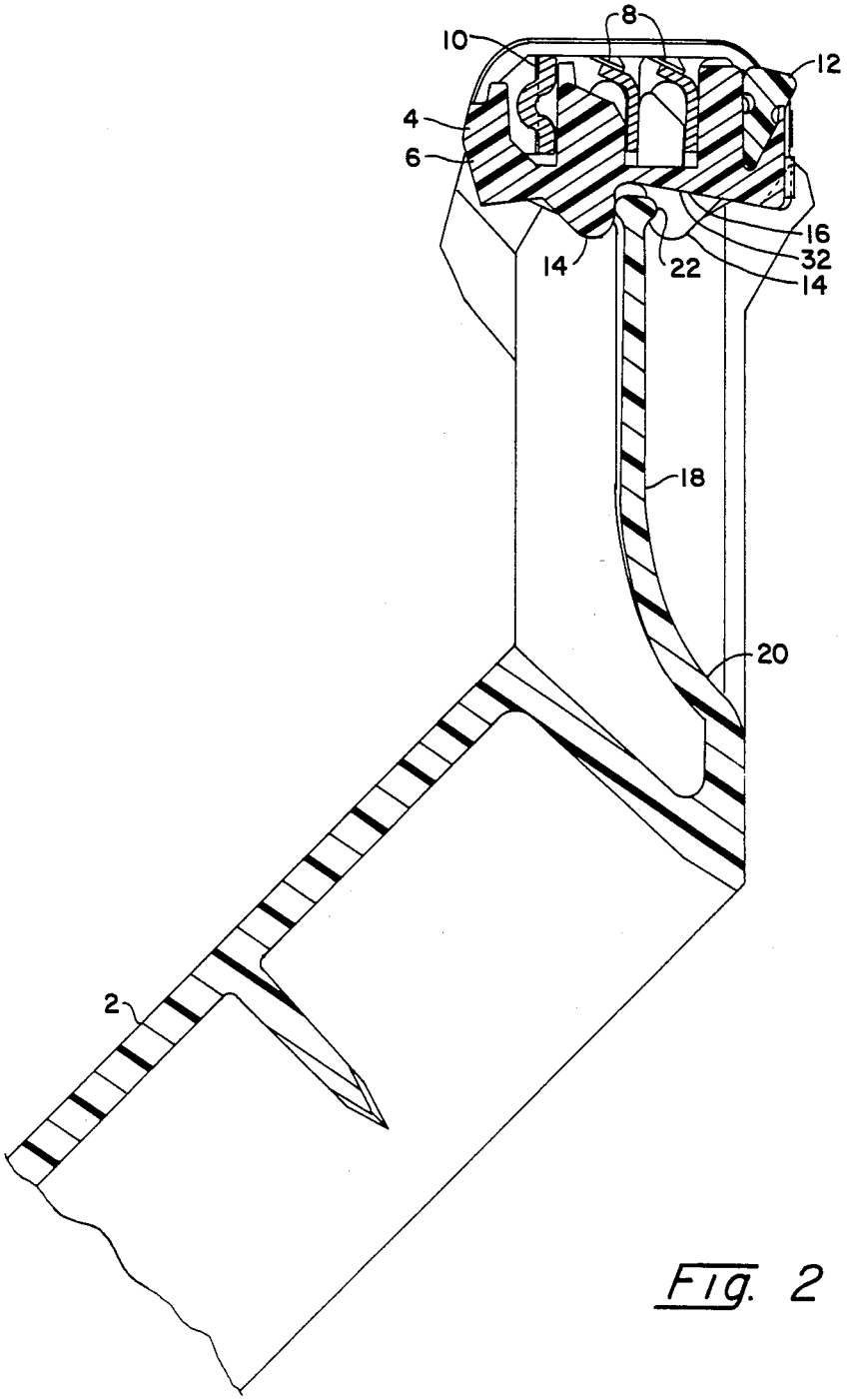
FIG. 2 is a sectional View of the razor of FIG. 1.

Referring to the drawings, and particularly FIGS. 1 and 2, it will be seen that the illustrative razor includes a handle 2 and a blade unit 4 mounted on the handle for pivotal movement, as is fully described in U.S. Pat. No. 4,488,357, issued Dec. 18, 1984 to Chester F. Jacobson.

The blade unit includes a housing 6 having blade means 8 disposed therein, as well as a guard member 10, all as described in the '357 patent. The blade unit may be provided with a strip of shaving aid material 12, attached to the cartridge as shown in FIG. 2, and as is fully described in U.S. Pat. No. 4,586,255, issued May 6, 1986 to Chester F. Jacobson.

Figure 3:
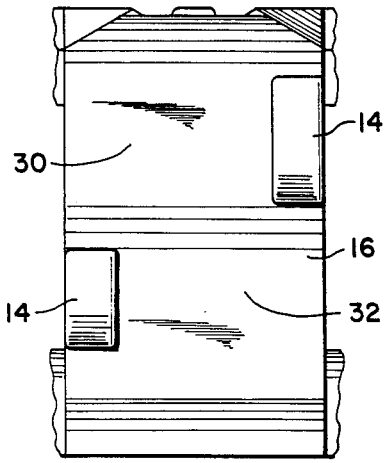
FIG. 3 is a bottom view of a central portion of the blade unit showing the projections extending therefrom.
Figure 4:
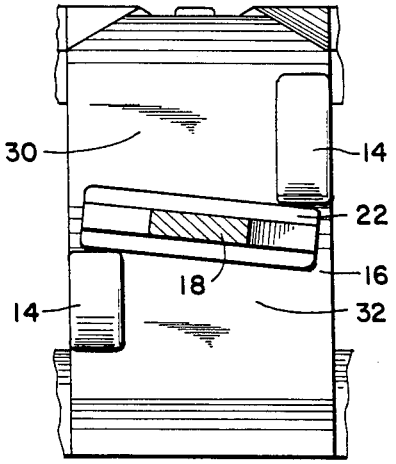
FIG. 4 is similar to FIG. 3, but shows the spring member in engagement with the projections, the spring finger being twisted about its lengthwise axis.

Referring to FIGS. 2, 3 and 4, it will be seen that the blade unit is provided with a pair of non-aligned projections 14 extending from an undersurface 16 of the cartridge toward the handle. The handle 2 is provided with an elongated leaf spring 18 extending from the handle toward the blade unit 4. The leaf spring 18 is fixed at a first end thereof 20 to the handle, preferably being molded integrally therewith. A second end 22 of the leaf spring is disposed between the projections 14, as is shown in FIGS. 2 and 4, and is in contact with the projections.

The spring 18 is twisted about its lengthwise axis and this second or free end 22 of spring 18 is enlarged to exceed the width of the width of the lateral spaced distance between said non aligned projections, as best seen in FIGS. 2 and 4. is retained in its twisted condition by the projections 14 (FIG. 4). The leaf spring 18 accordingly exercises a force against the projections to cause the blade unit, during a shaving operation, to be biased toward a neutral position. Even in the neutral position, the twisted leaf spring exercises an equal force upon the two projections, imparting to the blade unit the "feel" of being at all times under a bias. As noted above, the prior art razors having integrally-molded springs for centering shaving units tend to leave the blade unit in the neutral position with a detectable "dead" feel. In the prior art molded razors, the blade unit picks up a detectable bias only after substantial pivoting movement. The leaf spring 18 of the present invention imparts a bias to the blade unit even in the absolute neutral position.

In operation, the blade unit responds immediately to the slightest off-set from the neutral position, and in the neutral position has a more reassuring feel to the operator.

The blade unit 4 may, if desired, be provided with cam surfaces 30, 32 adapted for engagement with the type of cam follower disclosed in the above-mentioned '016 (first embodiment); '063; and '357 patents. Thus, the blade unit may be used with any of several types of centering spring means.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters patent of the United States is:

1. A razor comprising a handle and a blade unit mounted on said handle for pivotal movement thereon, said blade unit comprising a housing having blade means, therein, a pair of non aligned projections extending from an underside of said housing toward said handle and a leaf spring extending from said handle toward said blade unit, said leaf spring being fixed at a first end to said handle, a second free end on said leaf spring exceeding in width the distance between said non aligned projections, said spring being in a twisted condition by the free second end of said leaf spring engaging said non aligned projections, said spring having a bias toward an un-twisted condition and thereby exercising a force on each of said projections to cause said blade unit to be biased toward a neutral position on said handle.

2. The razor in accordance with claim 1 in which said handle is of molded plastic and said leaf spring is molded integrally with said handle.

* * * * *